United States Patent [19]

Sakamoto et al.

[11] Patent Number: 4,703,506

[45] Date of Patent: Oct. 27, 1987

[54] DIRECTIONAL MICROPHONE APPARATUS

[75] Inventors: Atsushi Sakamoto; Makoto Iwahara, both of Sagamihara, Japan

[73] Assignee: Victor Company of Japan, Ltd., Japan

[21] Appl. No.: 888,057

[22] Filed: Jul. 22, 1986

[30] Foreign Application Priority Data

Jul. 23, 1985 [JP] Japan ..... 60-162572

[51] Int. Cl.[4] ..... H04R 3/00

[52] U.S. Cl. ..... 381/92; 367/125; 367/126

[58] Field of Search ..... 367/121, 126, 123, 125; 381/92, 122, 26

[56] References Cited

U.S. PATENT DOCUMENTS 4,025,894 5/1977 Ziese ..... 367/126
4,485,484 11/1984 Flanagan ..... 381/92
4,536,887 8/1986 Kaneda et al. ..... 381/92

FOREIGN PATENT DOCUMENTS 56-08994 1/1981 Japan ..... 381/92
59-149494 8/1984 Japan .

OTHER PUBLICATIONS

S. Ibaraki et al: "2nd-Order Gradient Microphone Alley" Acoustic Research Lab. Matsushita Elec. Ind. Co., Ltd.; Mar. 1984.

Yoshihiko, ABE et al: "Practical Application and Digital Control of the Microphone Array"; AES, Presented at the 76th Convention 1984 Oct. 8–11, New York.

*Primary Examiner*—Forester W. Isen

*Attorney, Agent, or Firm*—Lowe, Price, Leblanc, Becker & Shur

[57] ABSTRACT

A directional microphone apparatus includes an array of at least three sets of microphone units, circuits for processing the output signals from the microphone units to produce a first signal which varies in accordance with the second order bidirectional sound pressure gradient characteristic of the array, weighting circuits for applying respective weighting coefficients to the output signals from the microphone units in accordance with a desired shape of directivity response characteristic, to produce corresponding weighted signals which are combined to form a second signal. The first and second signals are combined to produce an output signal which exhibits sharp directivity even at relatively low frequencies in the audio range.

10 Claims, 17 Drawing Figures

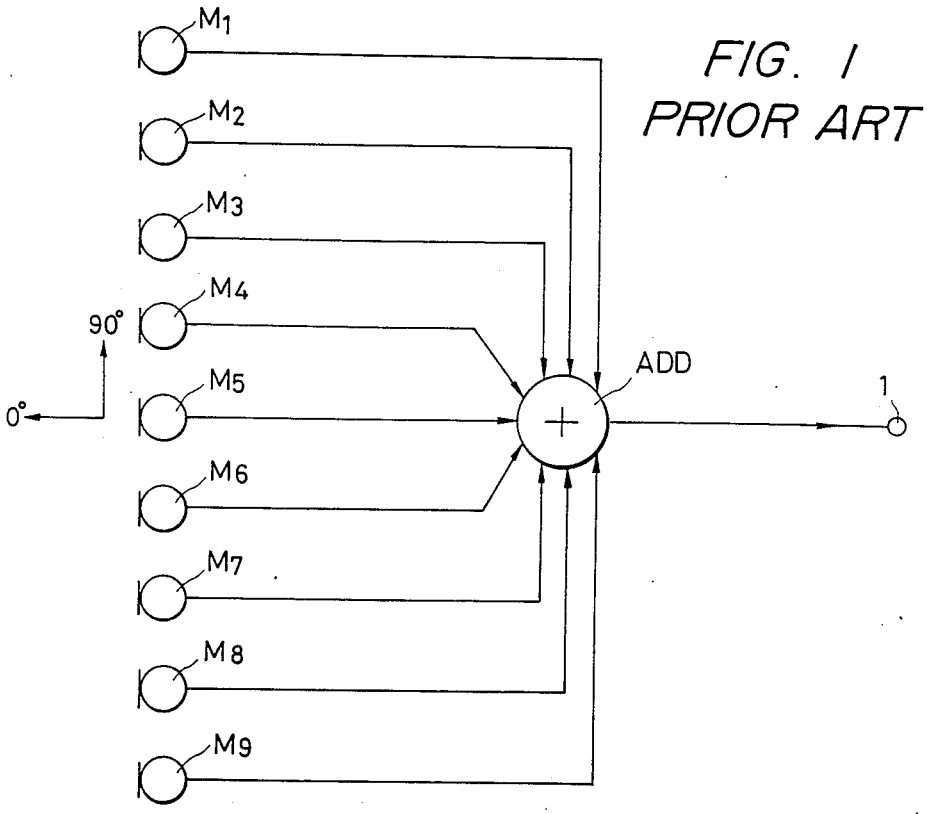
FIG. 1
PRIOR ART
FIG. 2
PRIOR ART
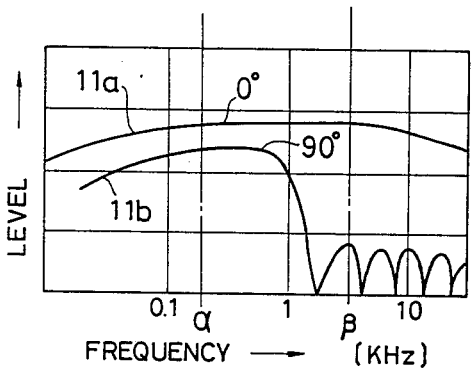
PRIOR ART
FIG. 3a
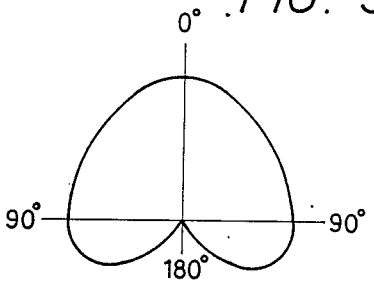
FIG. 3b
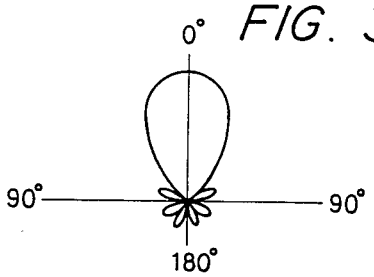

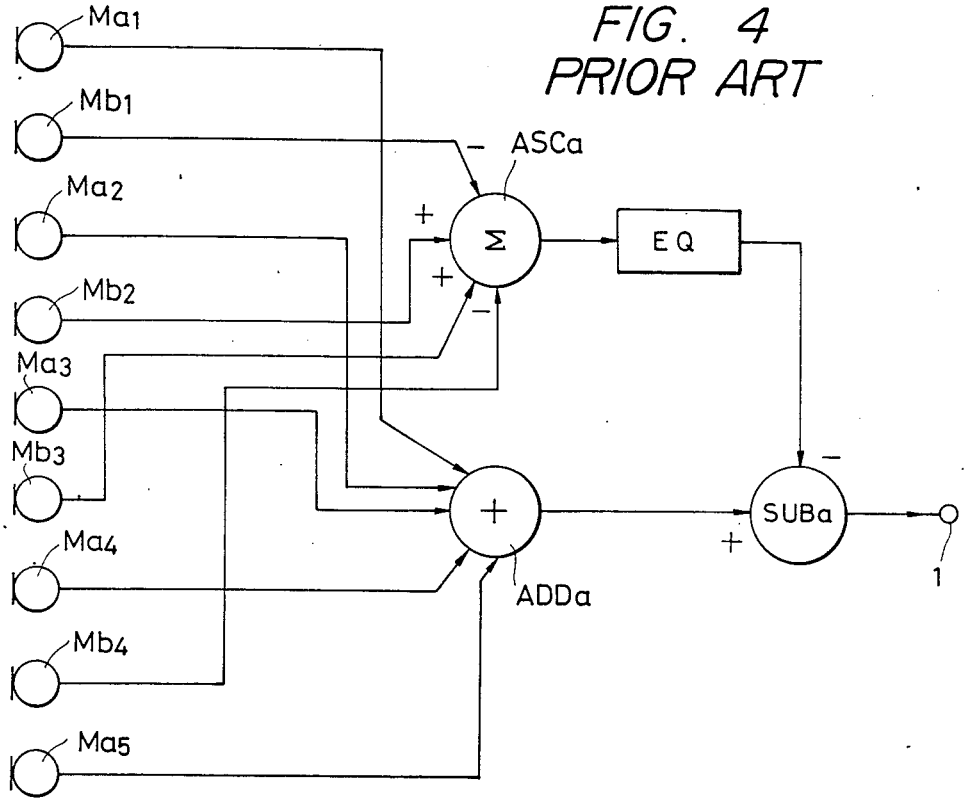
FIG. 4
PRIOR ART
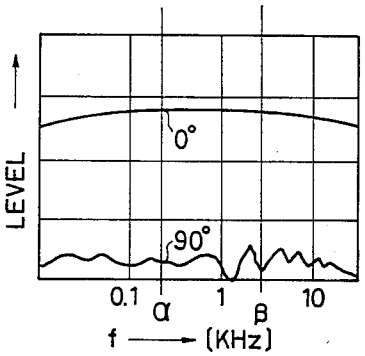
FIG. 5
PRIOR ART
PRIOR ART
FIG. 6a
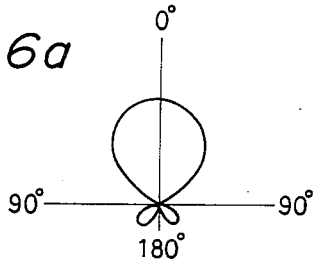
FIG. 6b
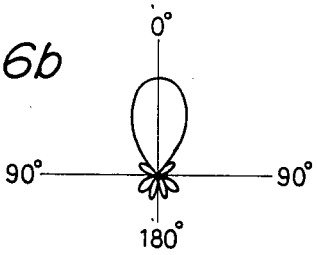

DIRECTIONAL MICROPHONE APPARATUS

BACKGROUND OF THE INVENTION

The present invention relates to a directional microphone apparatus employing an array of microphone units to provide sharp directivity, and in particular to a directional microphone apparatus of this type whereby the range of sharp directivity extends down to relatively low frequencies within the audio range.

FIG. 1 illustrates an example of a prior art type of directional microphone apparatus in which an array of microphone units M1 to M9 are arranged in line to provide sharp directivity along the direction indicated as 0°. Such a microphone apparatus provides sharp directivity within a specific plane, e.g. the horizontal plane, in which the microphone units are linearly arrayed, with directivity in the vertical direction being determined by the directivity response of the individual microphone units. The microphone units M1 to M9 are unidirectional units, whose output signals are summed by an addition circuit ADD to produce an output signal which is applied to an output terminal 1. The frequency response of the output signal from such a prior art directional microphone apparatus is of the form shown in FIG. 2, with the curve indicated as "0°" being the characteristic for sound reception in the 0° direction indicated in FIG. 1, and the curve indicated as "90°" being that for reception in the 90° direction. FIG. 3*a* shows the directional response characteristic of the directional microphone apparatus of FIG. 1 at the low frequency indicated as $\alpha$ in FIG. 2, while FIG. 3*b* shows the corresponding response at the high frequency indicated as $\beta$ in FIG. 2. It can thus be understood that the prior art apparatus of FIG. 1 provides sharp directivity within a range of relatively high frequencies, but provides very much less sharp directivity within a lower range of frequencies. This is due to the fact that the directivity of the microphone unit array at low frequencies becomes determined by the directivity of each of the individual microphone units. This difference in directivity between these high frequency and low frequency ranges presents various problems, e.g. with respect to attaining high fidelity sound reproduction, pick-up of sounds from unwanted sources, etc.

FIG. 4 shows an example of a prior art type of directional microphone apparatus which has been proposed for overcoming the problem described above. In FIG. 4, Ma1 to Ma5 respectively denote unidirectional microphone units, while Mb1 to Mb4 denote omnidirectional microphone units. The output signals from the unidirectional microphone units Ma1 to Ma5 are summed by an addition circuit $ADD_a$, while the output signal from the addition circuit $ADD_a$ is inputted to a subtraction circuit $SUB_a$. Of the output signals from the omnidirectional microphone units Mb1 to Mb4, the output signals from Mb2 and Mb3 are applied to respective addition inputs of an addition/subtraction circuit $ASC_a$, while the output signals from the units Mb1 and Mb4 are applied to respective subtraction inputs of addition/subtraction circuit $ASC_a$. An output signal is thereby produced from the addition/subtraction circuit $ASC_a$ which represents the second order bidirectional sound pressure gradient characteristic of the microphone unit array. This signal is inputed to an equalizer circuit EQ, and the resultant equalized output signal is applied to a subtraction input of subtraction circuit $SUB_a$, to be subtracted therein from the output signal from addition circuit $ADD_a$.

The frequency components of the output signal from addition/subtraction circuit $ASC_a$ in the low-frequency range, for the 90° reception direction, will be almost identical to the corresponding low-frequency components of the output signal from $ADD_a$. As a result, the output signal from $SUB_a$ resulting from subtraction of the equalized output signal from $ASC_a$ from the output signal of $ADD_a$ will have improved directivity in the low-frequency range. The frequency response of this output signal from is of the form shown in FIG. 5, with the curves designated "0°" and "90°" corresponding to those of FIG. 2 described above. FIG. 6*a* shows the directional response characteristic of the output signal from $SUB_a$ at the low frequency indicated as $\alpha$ in FIG. 5, while FIG. 6*b* shows the corresponding response at the high frequency indicated as $\beta$ in FIG. 5. It can thus be understood that directivity in the low-frequency range is provided by the prior art directional microphone apparatus example of FIG. 4, by comparison with that of FIG. 1. However the apparatus of FIG. 4 has the basic disadvantage that it is necessary to provided additional microphone units by comparison with the number of microphone units required in the directional microphone apparatus of FIG. 1 (i.e. to attain comparable directivity in the high-frequency range), these additional microphone units being omnidirectional. This results in substantially increased manuacturing cost. In addition, the incorporation of these additional microphone units into the microphone unit array will result in a reduction of the signal/noise ratio of the output signal from the directional microphone apparatus. In order to compensate for this lowering of the signal/noise ratio, it would be necessary to incorporate additional unidirectional and omnidirectional microphone units into the microphone unit array, which again will result in increased manufacturing cost.

SUMMARY OF THE INVENTION

The present invention comprises a directional microphone apparatus including an array of microphone units, whereby the disadvantages of the prior art described above are eliminated, e.g. whereby sharp directivity in the low audio frequency range is achieved without the necessity for employing additional omnidirectional microphone units.

Basically, a directional microphone apparatus according to the present invention comprises an array of at least three sets of microphone units, means for processing the output signals from the microphone units to produce a first signal which varies in accordance with the second order bidirectional sound pressure gradient characteristic of the array, means for applying respective weighting coefficients to the output signals from the microphone units in accordance with a desired shape of response directivity, to produce a second signal, and means for combining the first and second signals to produce an output signal which exhibits sharp directivity even at frequencies in the low audio range.

More specifically, a directional microphone apparatus according to the present invention comprises a plurality of microphone units arranged in a specific configuration to form a microphone unit array, the microphone unit array being divided into at least three sets of microphone units, with each of the microphone units having sensitivity in a direction perpendicular to the direction of a main lobe of said microphone apparatus and with each of the sets of microphone units comprising at least one microphone unit; a plurality of first addition circuit means each coupled to receive output signals from each of the microphone units of a corresponding one of the sets of microphone units, to produce a corresponding sum signal for each of the microphone unit sets; signal processing means for processing the sum signals from each of the addition circuits, for thereby producing a first signal which conforms to a second order bidirectional sound pressure gradient characteristic; a plurality of weighting circuits coupled to receive the output signals from respective ones of the microphone units, for producing corresponding weighted signals in accordance with predetermined weighting coefficients; second addition circuit means for summing the weighted signals to produce a second signal; equalizer circuit means coupled to receive a specific one of the first and second signals, for producing an equalized signal having signal components within a predetermined range of low frequencies in the audio frequency range which are substantially identical to corresponding signal components in the other one of the first and second signals under a condition in which identical sound waves are applied to all of the microphone units, and; combining circuit means for combining the equalized signal with the other one of the first and second signals to produce an output signal from the directional microphone apparatus.

BRIEF DESCRIPTION OF THE DRAWINGS

FIG. 1 is a general block diagram of an example of a prior art directional microphone apparatus employing an array of microphone units;

FIG. 2 shows the frequency response characteristic of the directional microphone apparatus example of FIG. 1;

FIGS. 3*a* and 3*b* show the directional responses of the directional microphone apparatus example of FIG. 1 at a low and at a high frequency, respectively;

FIG. 4 is a general block diagram of a second example of a prior art directional microphone apparatus employing an array of microphone units, for providing improved directivity at low frequencies;

FIG. 5 shows the frequency response characteristic of the directional microphone apparatus example of FIG. 4;

FIGS. 6*a* and 6*b* show the directional responses of the directional microphone apparatus example of FIG. 4 at a low and at a high frequency, respectively;

DESCRIPTION OF THE PREFERRED EMBODIMENTS

Figure 7:
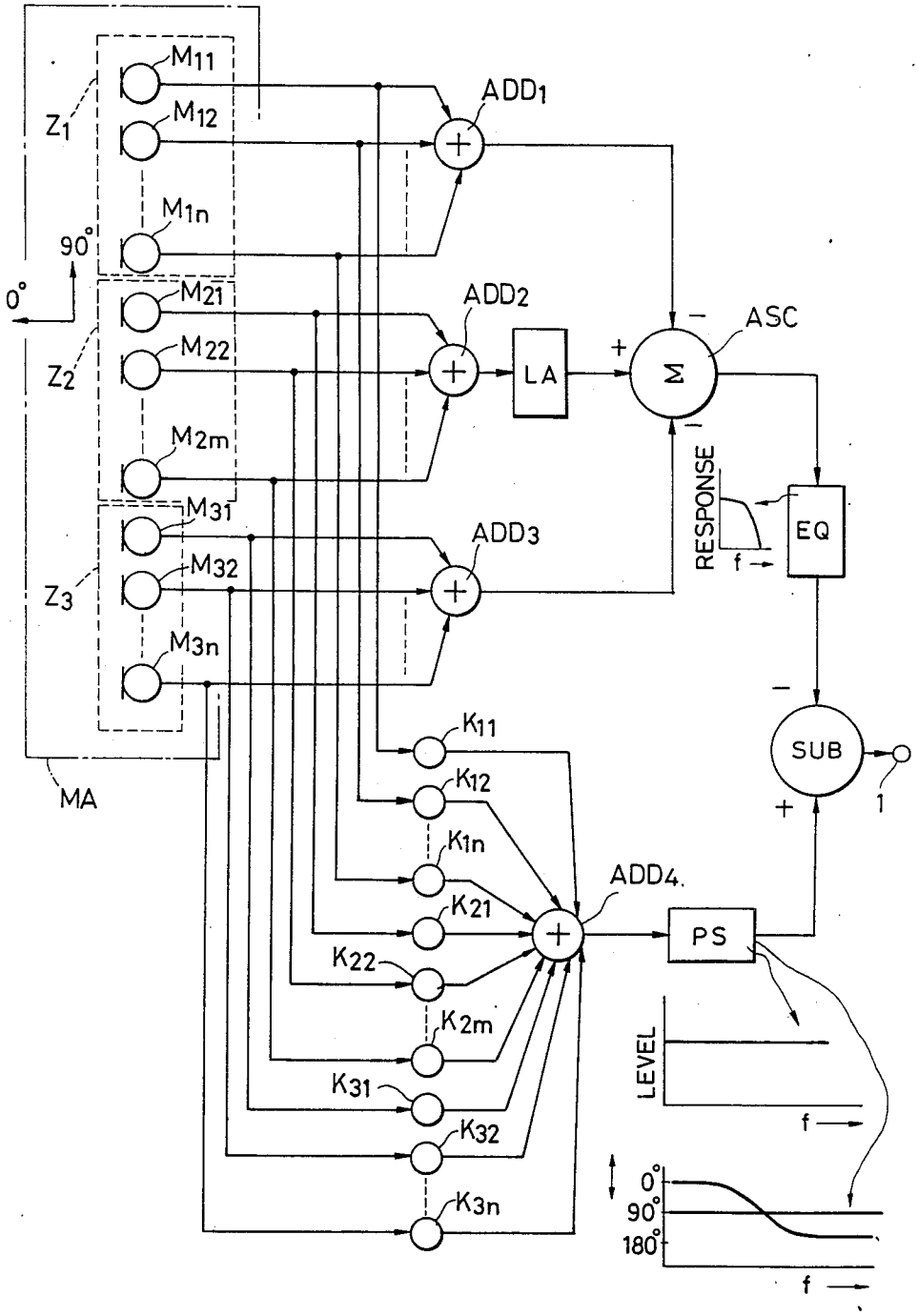
FIG. 7 is a general block diagram of an embodiment of a directional microphone apparatus according to the present invention.

An embodiment of a directional microphone apparatus according to the present invention will now be described, referring to the drawings. FIG. 7 is a general block diagram of this embodiment, in which M11 to M1*n*, M21 to M2*m*, M31 to M3*n* respectively denote three sets of microphone units, with each of these microphone units containing a given number of microphone units and with the microphone units in each set and the three sets of microphone units being successively arrayed in a specific orientation to form an array MA. In FIG. 7, the microphone units M11 to M1*n*, M21 to M3*n*, M31 to M3*n* are shown arrayed in line, however the invention is not limited to such an orientation for the microphone unit array. In addition the invention is not limited to the use of three sets of microphone units, but in general can include at least three sets of microphone units, with at least one microphone unit in each of these sets. Each of the microphone units has sensitivity in a direction perpendicular to the direction of a main lobe of the microphone apparatus. The former direction of sensitivity and the latter direction of the main lobe are shown in FIG. 7 by arrows denoted by 90° and 0° respectively.

The set of microphone units M11 to M1*n* will be designated in the following as the first microphone unit set Z1, the set of microphone units M21 to M2*n* as the second microphone unit set Z2, and microphone units M31 to M3*n* as the third microphone unit set Z3. As shown, the second microphone unit set Z2 is positioned centrally in the array MA, with the first and third microphone unit sets Z1 and Z3 positioned symmetrically about the microphone unit set Z2. The output signals from the set of microphone units Z1 are summed in a first addition circuit $ADD_1$, the output signals from the second set of microphone units Z2 are summed in a second addition circuit $ADD_2$, and the output signals from the third set of microphone units Z3 are summed in a third addition circuit $ADD_3$. The output signal from the first addition circuit $ADD_1$ is applied to one subtraction input of an addition/subtraction circuit ASC, while the output signal from the third addition circuit $ADD_3$ is applied to another subtraction input of addition/subtraction circuit ASC. The output signal from the second addition circuit $ADD_2$ is applied to a level adjustment circuit LA, which produces a level-adjusted output signal which is twice the amplitude of the output signal from $ADD_2$, but is otherwise identical to that signal. Thus, the output signal from level adjustment circuit LA will be identical in amplitude to the sum of the output signals from addition circuits $ADD_1$ and $ADD_3$ under a condition of identical sound waves being simultaneously applied to all of the microphone units of array MA. The output signal from level adjustment circuit LA is applied to an addition input of the addition/subtraction circuit ASC.

Figure 8:
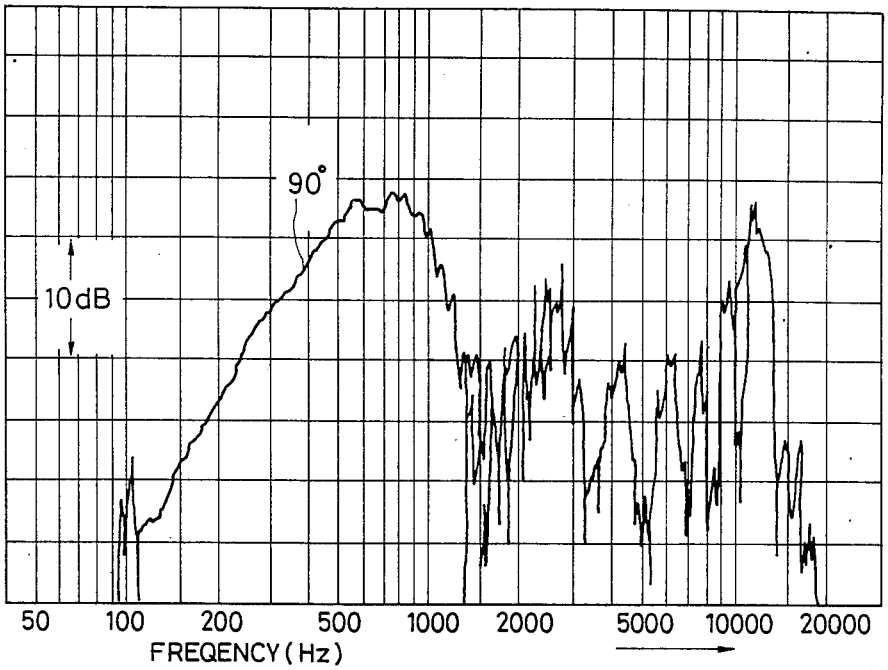
FIG. 8 shows an example of a frequency response characteristic of a first signal produced in the embodiment of FIG. 7, for the 90° reception direction.
Figure 9:
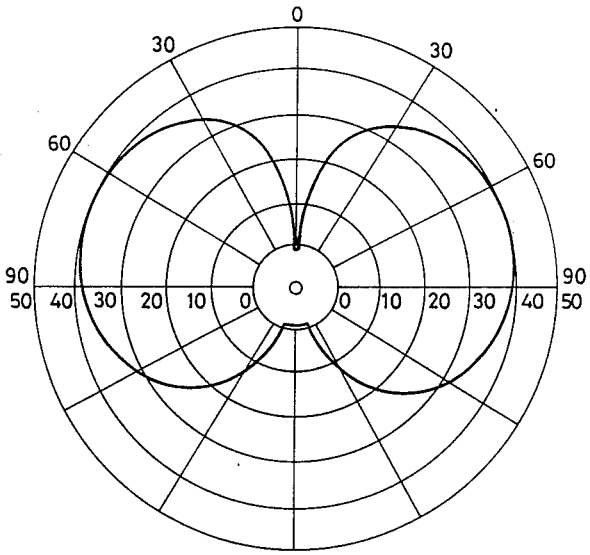
FIG. 9 shows the directional response of the first signal in the embodiment of FIG. 7, expressing a second order bidirectional sound pressure gradient characteristic.

The three input signals applied to the addition/subtraction circuit ASC are processed therein, to produce a signal which expresses the second order bidirectional sound pressure gradient characteristic of the microphone unit array MA, and which will be referred to hereinafter as the first signal. This first signal is inputted to an equalizer circuit EQ. The frequency characteristic of the first signal is shown in FIG. 8, while FIG. 9 is a polar diagram illustrating the second order bidirectional sound pressure gradient characteristic which is exhibited by the first signal at a frequency of 500 Hz. The characteristics shown in FIGS. 8 and 9, as is also true for those of FIGS. 10, 11 and 14, 15 described hereinafter, are plotted for the case of a microphone unit array made up of three sets of microphone units with each microphone unit set consisting of seven unidirectional microphone units, for a total of 21 microphone units. The microphone units are respectively spaced apart by intervals of 28.3 mm.

The output signals from microphone units M11 to M1*n*, M21 to M2*m*, M31 to M3*n* constituting array MA are modified in amplitude in accordance with respective specific weighting coefficients, by respective weighting circuits K11 to K1*n*, K21 to K2*m*, K31 to K3*n*. The resultant weighted signals from the weighting circuits K11 to K1*n*, K21 to K2*n*, K31 to K3*n* are applied to respective addition inputs of a fourth addition circuit $ADD_4$. The specific values of weighting coefficient which are respectively assigned to the output signals from microphone units M11 to M1*n*, M21 to M2*m*, M31 to M3*n* are determined in accordance with the required shapes for the main lobe and side lobes of the directional microphone apparatus response which are necessary for attaining a desired directivity characteristic.

Figure 10:
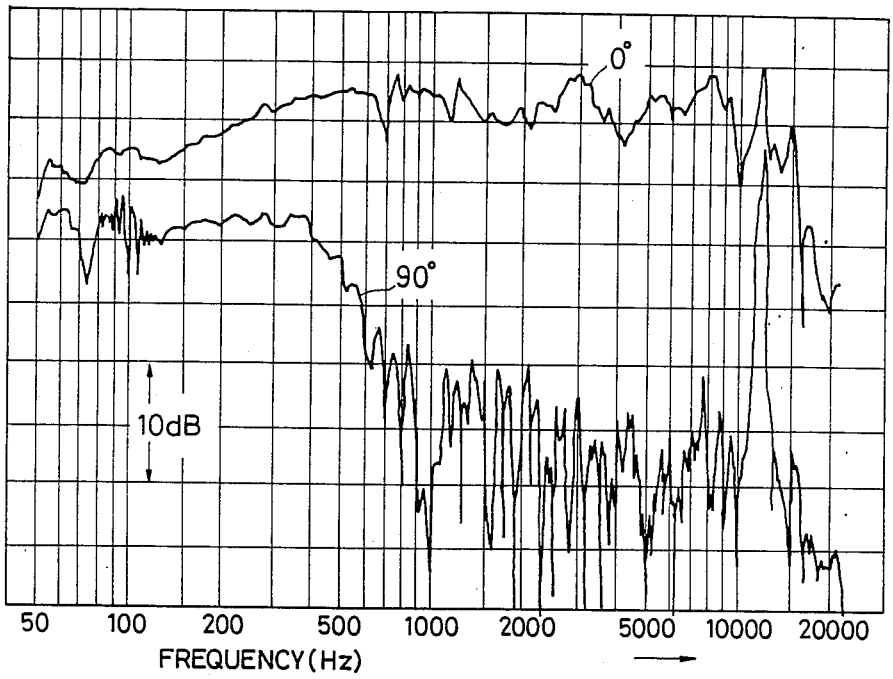
FIG. 10 shows examples of frequency response characteristics of a second signal produced in the embodiment of FIG. 7, for the 0° and the 90° directions of reception respectively.
Figure 11:
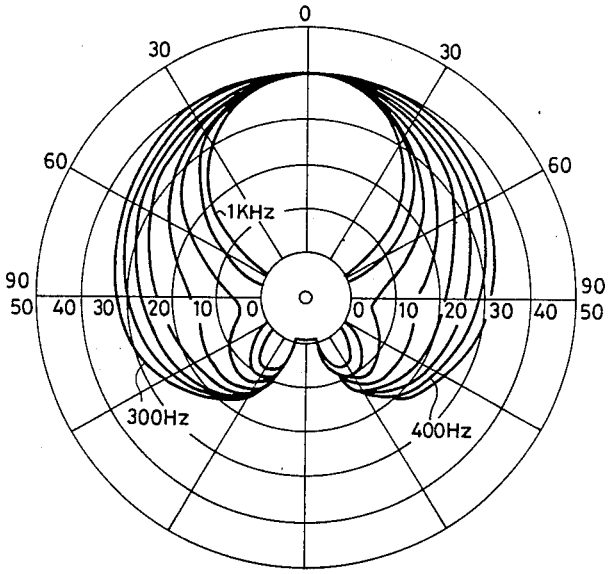
FIG. 11 shows the directional response of the second signal in the embodiment of FIG. 7, for differing frequencies in the low audio frequency range.
Figure 12:
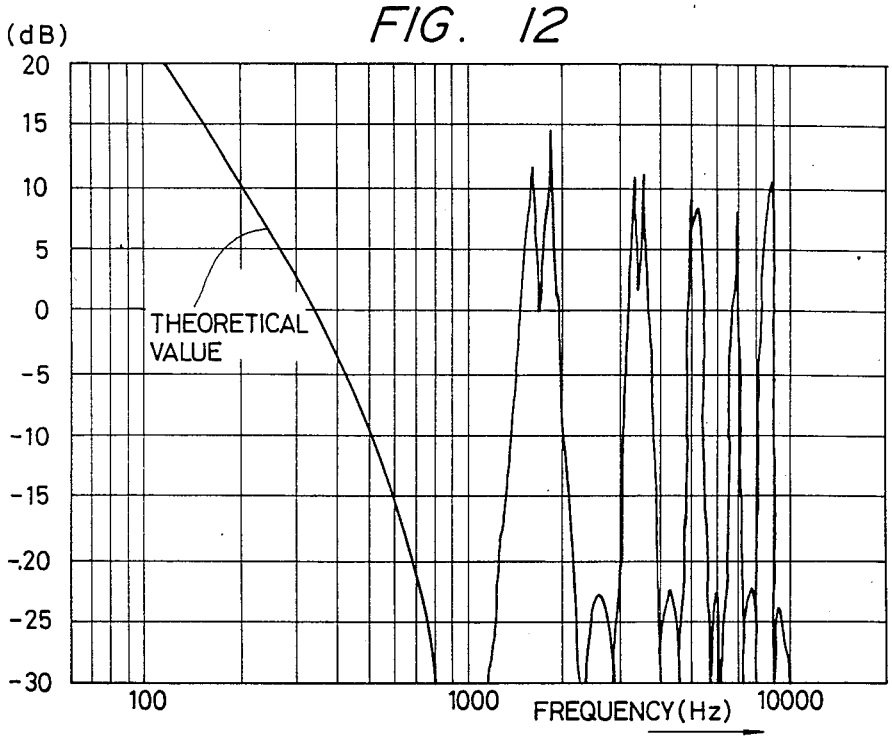
FIG. 12 shows a logical frequency response characteristic for an equalizer circuit EQ in the embodiment of FIG. 7.

The resultant output signal from addition circuit $ADD_4$, which will be referred to in the following as the second signal, is inputted to a phase shift circuit PS. FIG. 10 shows an example of the frequency response characteristic of the second signal, while FIG. 11 is a polar diagram showing the directional response characteristics of the second signal, for frequencies in the range 300 Hz to 1 KHz. The equalizer circuit EQ is configured such as to convert the first signal to an equalized signal whose frequency characteristics and phase characteristics for the 90° reception direction are substantially identical to the frequency characteristics and phase characteristics of the second signal, e.g. to produce as output a signal whose frequency response characteristic for the 90° direction is substantially identical to the frequency characteristic example shown in FIG. 8. For example, assuming that the frequency characteristic of the first signal for the 90° direction is as shown in FIG. 8 and that the corresponding frequency characteristic for the second signal is as shown in FIG. 10, then the equalizer circuit EQ should theoretically have the characteristic shown in FIG. 12, to produce precise equalization of the frequency response. However it is difficult in practice to implement an equalizer which will produce the precise theoretical characteristic shown in FIG. 12. In addition, a directional microphone apparatus of the type envisaged by the present invention will in generally be used in applications where extremely high fidelity of reproduction over the entire audio frequency range is not absolutely necessary, e.g. for sound reception at sports events, etc. It will therefore be generally possible to employ a low-pass filter to perform the function of equalizer circuit EQ, which will provide a sufficiently good degree of equalization within a specific band of frequencies in the low audio frequency range, e.g. in the range 300 Hz to 1 KHz.

Figure 13:
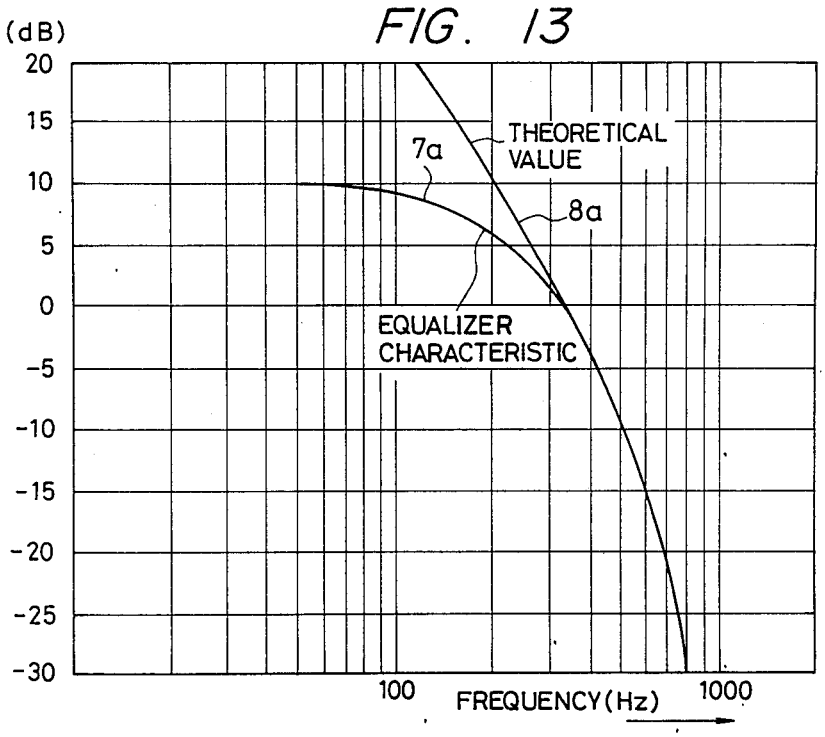
FIG. 13 shows a frequency response of a low-pass filter utilizable as an equalizer circuit in the embodiment of FIG. 7.

FIG. 13 shows an example of a frequency characteristic for a low-pass filter which approximately corresponds to the requisite portion of the theoretical frequency characteristic shown in FIG. 6, i.e. in the low frequency range described above. The corresponding portion of the logical equalization characteristic is also shown in FIG. 13, for comparison.

As is well known, passage of a signal through a low-pass filter will result in phase shift of frequency components of the signal which extend above the cut-off frequency region of the filter, with the maximum rate of phase transition with frequency occurring within the cut-off region. Thus with the present invention, if the first signal is passed through a low-pass filter functioning as the equalizer circuit EQ, it is necessary to apply corresponding phase compensation to the second signal. This is achieved by passing the second signal through the phase shift circuit PS, which applies to the second signal modifications of phase with frequency that are substantially identical to the variation of phase with frequency which occur for the first signal due to passage through the low-pass filter used as equalizer circuit EQ. The phase-shifted output signal from phase shift circuit PS and the output signal from the low-pass filter used as equalizer circuit EQ are respectively applied to an addition input and a subtraction input of a subtraction circuit SUB. The resultant output signal from subtraction circuit SUB (i.e. produced by subtracting the phase-shifted second signal from the equalized first signal) is coupled to an output terminal 1.

Figure 14:
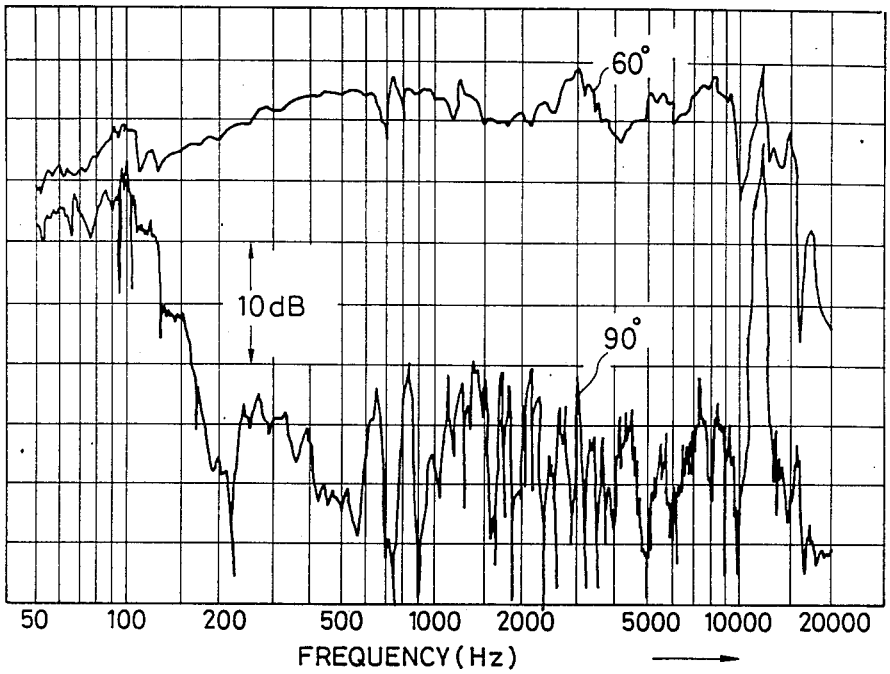
FIG. 14 shows an example of the frequency response characteristics of the embodiment of FIG. 7.
Figure 15:
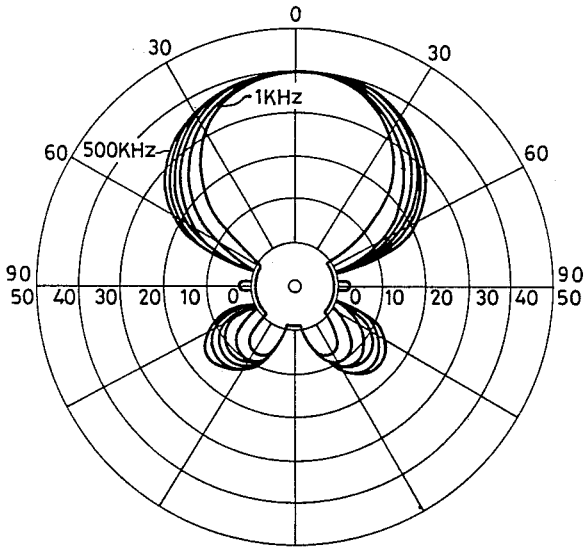
FIG. 15 shows the directional response characteristics of the embodiment of FIG. 7, for various low frequencies.

Examples of the frequency response characteristics of the signal which is thus inputted from terminal 1 of the directional microphone apparatus for the 60° and 90° reception directions are shown in FIG. 14, while FIG. 15 is a polar diagram showing the directivity response of this signal for the frequencies 500 Hz, 600 Hz, 700 Hz, 800 Hz, 900 Hz and 1 KHz. As can be seen from FIGS. 14 and 15, sharp directivity is attained in the 500 Hz to 1 KHz frequency range.

In the embodiment described above, the first signal is inputted to an equalizer circuit EQ while the second signal is inputted to a phase shift circuit PS. However it would also be possible to employ a configuration in which the second signal is inputted to the equalizer circuit and the first signal is inputted to the phase shift circuit. However the configuration of the described embodiment has the advantage that no reduction of reception sensitivity for the 0° direction will result from processing of signals in the addition/subtraction circuit ASC.

The present invention is not limited to the configuration of the described embodiment. For example, instead of employing three sets of microphone units (Z1, Z2 and Z3 in FIG. 7) to form the microphone unit array, it would be possible to employ four sets of microphone units, which are symmetrically disposed about the center of the microphone array each microphone unit having sensitivity extending through 90°. In this case it would be necessary to obtain the sum of the output signals from a specific pair of these four sets of microphone units and the sum of the output signals from the other two sets of microphone units, and two subtract one of these sum signals from the other, to thereby obtain the first signal. It would therefore not be necessary to employ the level adjustment circuit LA of the described embodiment. In all other respects, such a modified embodiment would be identical to the embodiment of FIG. 7.

From the above description it can be understood that a directional microphone apparatus according to the present invention provides sharp directivity in a specific direction, e.g. the horizontal direction, even at relatively low audio frequencies, for example the 300 Hz to 1 KHz range, and that this is achieved without the necessity to employ additional microphone units as in the prior art example of FIG. 4. The disadvantages of high manufacturing cost and decreased signal/noise ratio which are entailed by such additional microphone units are thereby eliminated by the present invention.

Although the present invention has been described in the above with reference to specific embodiments, it should be noted that various changes and modifications to the embodiments may be envisaged, which fall within the scope claimed for the invention as set out in the appended claims. The above specification should therefore be interpreted in a descriptive and not in a limiting sense.

What is claimed is:

1. A directional microphone apparatus comprising:

a plurality of microphone units arranged in a specific configuration to form a microphone unit array, said microphone unit array being divided into at least three sets of microphone units, with each of said microphone units having sensitivity in a direction perpendicular to the direction of a main lobe of said microphone apparatus and with each of said sets of microphone units comprising at least one of said microphone units;

a plurality of first addition circuit means each coupled to receive output signals from each of said microphone units of a corresponding one of said sets of microphone units, to produce a corresponding sum signal for each of said microphone unit sets;

signal processing means for processing said sum signals from each of said addition circuits, for thereby producing a first signal which conforms to a second order bidirectional sound pressure gradient characteristic;

a plurality of weighting circuits coupled to receive said output signals from respective ones of said microphone units, for producing corresponding weighted signals in accordance with predetermined weighting coefficients;

second addition circuit means for summing said weighted signals to produce a second signal;

equalizer circuit means coupled to receive a specific one of said first and second signals, for producing an equalized signal having signal components within a predetermined range of low frequencies in the audio frequency range which are substantially identical to corresponding signal components in the other one of said first and second signals under a condition in which identical sound waves are simultaneously applied to all of said microphone units; and combining circuit means for combining said equalized signal with said other one of said first and second signals to produce an output signal from said directional microphone apparatus.

2. A directional microphone apparatus according to claim 1, in which said combining circuit means comprise a subtraction circuit.

3. A directional microphone apparatus according to claim 1, in which each of said sets of microphone units contains an identical number of said microphone units.

4. A directional microphone apparatus according to claim 3, in which said array of microphone units is formed of three of said sets of microphone units.

5. A directional microphone apparatus according to claim 4, in which said signal processing means comprises a level adjustment circuit which is coupled to receive said sum signal of a specific one of said microphone units, for producing a level adjusted signal having an amplitude which is double the amplitude of each of said sum signals of the other two of said sets of microphone units, under a condition in which identical sound waves are applied to all of said microphone units, and means for subtracting said sums signals of said other two sets of microphone units from said level adjusted signal, to thereby produce said second signal.

6. A directional microphone apparatus according to claim 3 in which said said array of microphone units is formed of four of said sets of microphone units.

7. A directional microphone apparatus according to claim 6, in which said signal processing means comprises means for subtracting said sum signals of a specific pair of said sets of microphone units from said sum signals of the other two of said sets of microphone units, to thereby produce said first signal.

8. A directional microphone apparatus according to claim 1, and further comprising a phase shift circuit coupled to receive said output signal from said second addition circuit means, for applying phase compensation thereto such as to compensate for a phase shift produced by said equalizer circuit means, to thereby produce said second signal as an output signal from said phase shift circuit.

9. A directional microphone apparatus according to claim 1, in which said equalizer circuit means comprises a low-pass filter circuit.

10. A directional microphone apparatus according to claim 1, in which said microphone units are linearly arrayed with fixed spacings therebetween.

* * * * *